United States Patent [19]

Nunez

[11] 3,951,414

[45] Apr. 20, 1976

[54] GOLF PUTTING AID

[76] Inventor: Bernard E. Nunez, 5952 Searl Terrace, Bethesda, Md. 20016

[22] Filed: Apr. 14, 1975

[21] Appl. No.: 567,813

[52] U.S. Cl. ..... 273/183 B; 273/183 E; 273/DIG. 17

[51] Int. Cl.[2] ..... A63B 69/36

[58] Field of Search .... 273/183, 188, 190, DIG. 17, 273/54 B; 35/29 A

[56] References Cited

UNITED STATES PATENTS

| | | | |
|---|---|---|---|
| 1,851,433 | 3/1932 | Israel | 273/DIG. 17 |
| 3,545,764 | 12/1970 | Broderick | 273/183 B |
| 3,613,294 | 10/1971 | Graham | 273/DIG. 17 |

*Primary Examiner*—George J. Marlo
*Attorney, Agent, or Firm*—Lane, Aitken, Dunner & Ziems

[57] ABSTRACT

A device for aligning a golfer's dominant eye with a golf ball and cup comprising a mask adapted to be secured to the head of a golfer. The mask covers the non-dominant eye and has an opening therein located and sized for allowing the dominant eye to view both the ball and the cup. A weighted cord is attached to the mask in the line of sight of the dominant eye for enabling the dominant eye to be vertically aligned over or behind a golf ball for proper alignment in the act of putting.

2 Claims, 2 Drawing Figures

GOLF PUTTING AID

BACKGROUND OF THE INVENTION

This invention relates to a device which can be used to aid a golfer in developing good putting technique and more particularly to a device which enable a golfer to practice aligning his dominant eye directly over the ball or in back of the ball in line with the cup while he is putting.

Putting is one of the more difficult golf strokes to master. One reason why many people experience difficulty in putting is because they are not aware of the proper way to align the ball with the cup. Proper alignment is as, if not more, important to accurate putting as a proper grip and stance.

It has been determined that a golfer must maintain his head stationary while addressing the ball during putting and other types of strokes. Devices have been developed which attach to the golfer's head to let him know if his head remains still during the stroke.

While maintaining the head stationary the golfer must align the ball with the cup. Some people advocate that the eyes should be centered over the ball. A device has been developed which shields the golfer's vision from all objects other than the ball itself and which provides for means to center the head over the ball.

However, these devices fail to recognize what I believe is the proper putting technique and that is that the dominant eye should be aligned with the ball similar to the alignment method used in playing billiards. In addition, instead of shielding the eyes from everything but the ball the dominant eye should have an unrestricted view of the ball and of the cup so that proper alignment can take place. Experiments have shown that many golfers putt better by being able to look at the cup instead of the ball which results in the putter stroking through the ball instead of at it.

SUMMARY OF THE INVENTION

In accordance with the invention, the problems discussed above are solved by providing a golf putting aid which covers the non-dominant eye and allows the dominant eye to see the ball and at the same time have an unrestricted view of the cup.

The device can be in the form of a leather or plastic band with an opening or aperture therein large enough so that the dominant eye can look through it and clearly see both the ball and cup, the band being adapted to be secured to the golfer's head. In order to align the dominant eye with the ball a weighted cord is attached to the band in such a way that the cord will hang vertically from the band in the line of sight between the dominant eye looking through the aperture and the golf ball. In this way, the dominant eye can easily be aligned directly over the ball or in back of the ball along the target-line with the cup.

Although such a device may not be used in tournament play, it will be useful during practice to enable the golfer to develop good putting technique and learn proper eye alignment.

BRIEF DESCRIPTION OF THE DRAWING

For a better understanding of the invention, reference may be had to the following description of an exemplary embodiment, taken in conjunction with the accompanying drawing in which.

DETAILED DESCRIPTION OF AN EXEMPLARY EMBODIMENT

Figure 1:
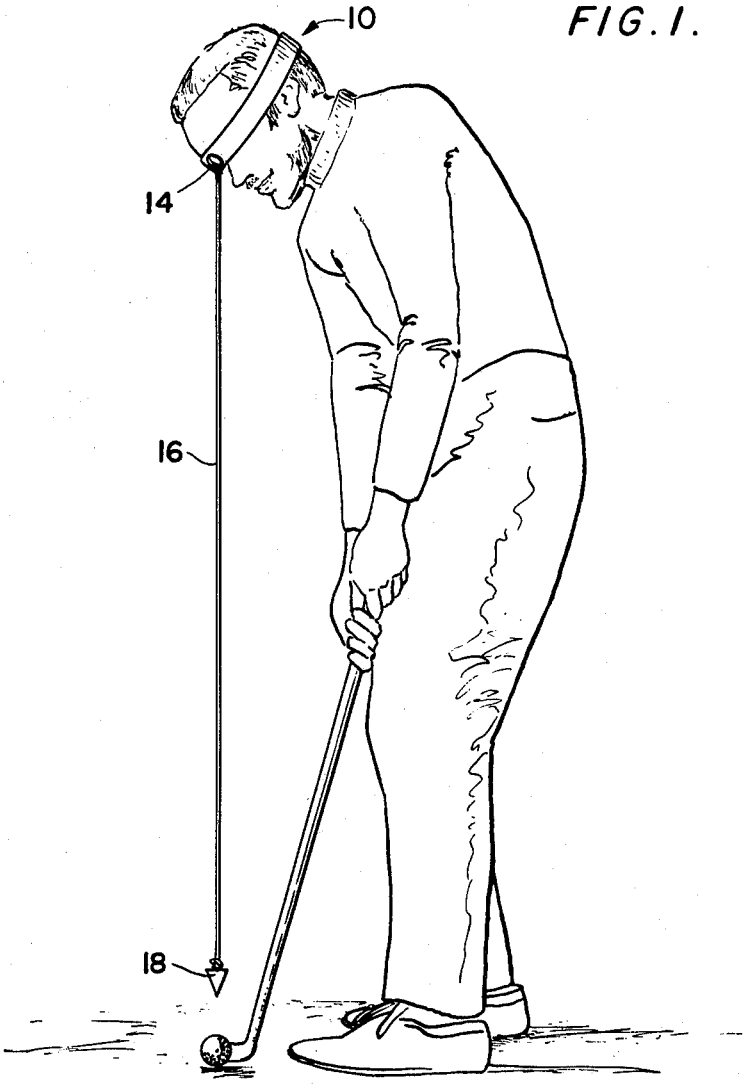
FIG. 1 shows a golfer in a putting stance with the golf putting aid attached to his head.
Figure 2:
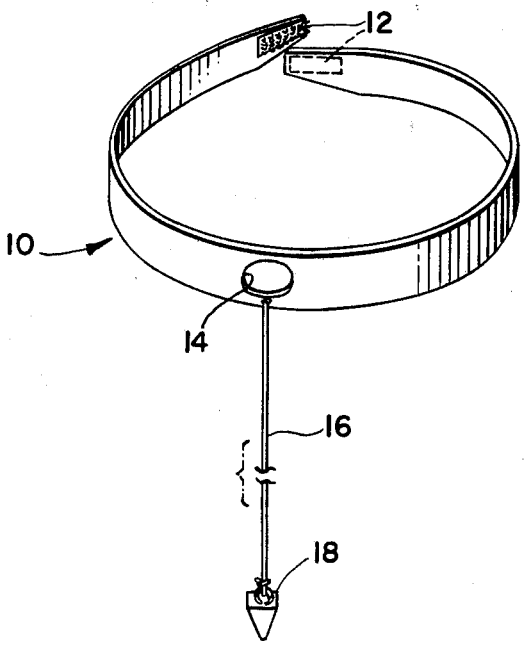
FIG. 2 is a front perspective view of the golf putting aid showing in particular the location of the aperture for the dominant eye and the weighted cord extending vertically from it.

Referring now to FIG. 1, a golfer is shown in a putting stance with the golf putting aid 10 attached to his head. As shown, the golfer is right-handed and his dominant eye is the right eye. The putting aid 10, as shown in FIGS. 1 and 2, is a mask for the non-dominant eye in the form of a band of light-impervious material such as leather or suitable plastic. The band can be attached to the head by providing an adjustable fastener 12 formed of a well known fastening means such as Velcro, which utilizes cooperating strips of fibers and hooks that will attach to each other when brought into engagement and can easily be separated. Alternatively, other types of fasteners or a band with an elastic portion may be provided.

The putting aid 10 also includes an opening or aperture 14 adapted to be positioned over the golfer's dominant eye. A cord 16 is attached to the band in such a way that the cord 16 will hang vertically from the line of sight between the dominant eye as it looks through the aperture 14 and the golf ball. The cord 16 maintains its vertical alignment by means of the weight 18 attached at the other end. As shown in FIG. 2, the cord 16 is preferably attached to the band directly below the aperture 14. This can be done either by providing a separate eyelet or opening in the band or by tying the cord 16 through the aperture 14. When the eyelet is provided, as shown in FIG. 2, the height of the weight 18 can easily be adjusted.

Thus, as shown in FIG. 1 by using the putting aid 10 the golfer can practice aligning his dominant eye in the proper way by positioning the weight 18 directly over the ball which is in the line of sight of the dominant eye or by positioning the weight 18 behind the ball in line with the cup. In order to provide proper alignment with the cup an imaginary line is drawn from the spot on the green over which the dominant eye is positioned, through the ball, to a point which intersects the cup. When the dominant eye is positioned directly over the ball, the ball should be (for a right-handed golfer) in the vicinity of his left toe as shown in FIG. 1. One advantage of the putting aid is that the dominant eye can be moved from the cup to the ball and back through a slight head movement to create a pendulum effect in the cord 16 and weight 18 to show the putter the proper line between the ball and cup along which the putt should be directed. Once that line is determined the head should remain still and the weight will not move to maintain proper vertical alignment of the dominant eye.

Thus, there is provided in accordance with the invention a putting aid 10 which will enable the golfer to practice aligning his dominant eye with the ball and cup. The putting aid 10 is simple in construction and easy to place on the head or to remove during practice. The embodiment of the invention described above is intended to be merely exemplary and those skilled in the art will be able to make modifications and variations to it without departing from the spirit and scope of the claims appended hereto.

I claim:

1. A golfer's training device consisting essentially of a band of light impervious material adapted to be secured around the head of a golfer and over the eyes of the golfer, a single aperture in said band adapted to be aligned with one of the golfer's eyes for permitting the golfer to view both the golf ball and putting cup, a cord having one end thereof attached to the band directly below said aperture, and a weight attached to the other end of said cord so that said cord may hang vertically from said band with said weight aligned over a predetermined sighting point.

2. The device in claim 1, wherein the band includes means for adjusting the length thereof.

* * * * *